US005979421A

United States Patent [19]

Yamashita et al.

[11] Patent Number: 5,979,421

[45] Date of Patent: Nov. 9, 1999

[54] CYLINDER HEAD EGR SYSTEM

[75] Inventors: Noriyuki Yamashita; Masato Nishigaki, both of Iwata, Japan

[73] Assignee: Yamaha Hatsudoki Kabushiki Kaisha, Iwata, Japan

[21] Appl. No.: 08/954,280

[22] Filed: Oct. 20, 1997

[30] Foreign Application Priority Data

Oct. 18, 1996 [JP] Japan ..... 8-276133

[51] Int. Cl.[6] ..... F02M 25/06; F02B 47/08

[52] U.S. Cl. ..... 123/568.12

[58] Field of Search ..... 123/568.11, 568.12, 123/568.13, 184.38–184.45; 60/323

[56] References Cited

U.S. PATENT DOCUMENTS

| | | | |
|---|---|---|---|
| 1,384,133 | 7/1921 | Howe | 123/316 |
| 4,106,449 | 8/1978 | Matsumoto et al. | 123/568.12 |
| 4,147,031 | 4/1979 | Tanuma et al. | 60/278 |
| 4,192,140 | 3/1980 | Yamashita et al. . | |
| 4,194,474 | 3/1980 | Endo . | |
| 4,221,203 | 9/1980 | Hayashi et al. | 123/568.29 |
| 4,231,339 | 11/1980 | Matsumoto et al. . | |
| 4,323,045 | 4/1982 | Yamashita . | |
| 4,367,719 | 1/1983 | Kimura et al. | 123/568.17 |
| 4,413,605 | 11/1983 | Leoni | 123/547 |
| 4,414,953 | 11/1983 | Matsumoto et al. . | |
| 4,782,797 | 11/1988 | Kurahashi . | |
| 4,811,697 | 3/1989 | Kurahashi . | |
| 4,867,109 | 9/1989 | Tezuka et al. . | |
| 5,329,912 | 7/1994 | Matsumoto et al. . | |

FOREIGN PATENT DOCUMENTS

| | | |
|---|---|---|
| 56-65153 | 6/1981 | Japan . |
| 1-93357 | 6/1989 | Japan . |
| 3-92515 | 9/1991 | Japan . |

*Primary Examiner*—Tony M. Argenbright
*Assistant Examiner*—Arnold Castro
*Attorney, Agent, or Firm*—Knobbe, Martens, Olson & Bear LLP

[57] ABSTRACT

An exhaust gas recirculation system for an engine having a cylinder head and an intake system and exhaust system is disclosed. The intake system includes an intake manifold connected to the cylinder head via a mounting flange such that a passage through the manifold is aligned with an intake passage through the cylinder head. The exhaust system includes an exhaust manifold connected to the cylinder head via a mounting flange such that an exhaust passage leading through the cylinder head is aligned with a passage through the exhaust manifold. The recirculation system includes a recirculation passage extending from the passage through the exhaust manifold through the flange thereof, through the cylinder head and then through the flange of the intake manifold into the passage thereof.

7 Claims, 5 Drawing Sheets

CYLINDER HEAD EGR SYSTEM

FIELD OF THE INVENTION

The present invention relates to an exhaust gas recirculation system. More particularly, the invention is an EGR system which includes a recirculation passage extending through a cylinder head of an internal combustion engine.

BACKGROUND OF THE INVENTION

Engines produce a number of exhaust gases, some of which are considered environmentally undesirable. One of these by-products is $NO_x$ compounds. $NO_x$ compounds are generated during the combustion of hydrocarbon fuels, especially at increased combustion temperatures.

Exhausting $NO_x$, whether into air or water, has detrimental effects on the environment. $NO_x$ exhausted into the air may either photoreact and create air pollution or chemically react and contribute to acid rain. $NO_x$ which is discharged into water, such as from outboard motors, is readily converted in reduction-type chemical reactions into acid. It has been found that even small changes in pH caused by the introduction of acid into a body of water may have an undesirable effect on plants and wildlife. As a result of these and other concerns regarding the effects of the engine exhaust, many principalities now regulate $NO_x$ output.

Controlling the exhaust gas content of engines, both those in automobiles and outboard motors, meets with some difficulties. The engine of an outboard motor is positioned within a very small housing or cowling. Likewise, the engines of newer automobiles must often be positioned in very small engine compartments. In both situations, little space remains apart from the base engine components for emission control equipment. In addition, high engine and emission control component temperatures are sometimes incompatible with certain engine components. In addition, the emission control components generally increase the complexity and cost of manufacture and assembly of the engine.

An apparatus and method for use in controlling the content of the exhaust gas produced by an internal combustion engine is desirable.

SUMMARY OF THE INVENTION

In accordance with the present invention there is provided an exhaust gas recirculation (EGR) system for an internal combustion engine. The EGR system is arranged to divert exhaust gases from an exhaust system of the engine to an intake system of the engine. The diverted exhaust gases have the effect of displacing a portion of the burnable air/fuel charge supplied to a combustion chamber of the engine, thus lowering the temperature of combustion and reducing the production of harmful emission products such as $NO_x$.

The EGR system is adapted for use with an engine having a cylinder head and an intake and exhaust system. The intake system includes an intake manifold comprising at least one intake pipe connected to a mounting flange. The intake manifold is connected to the cylinder head via the mounting flange, with a passage through the intake pipe aligned with an intake passage leading through the cylinder head to a combustion chamber.

The exhaust system includes an exhaust manifold comprising at least one exhaust pipe leading from a mounting flange. The exhaust manifold is connected to the cylinder head via the mounting flange, with a passage through the exhaust pipe aligned with an exhaust passage leading through the cylinder head from the combustion chamber.

The EGR system includes a passage for routing exhaust gas from the passage through the exhaust pipe through the flange of the exhaust manifold, through the cylinder head, and through the flange of the intake manifold into the passage through the intake pipe. This passage is preferably defined by a pipe extending between the exhaust pipe and the flange of the exhaust manifold, a passage through the cylinder head from the exhaust manifold to the intake manifold, and a pipe extending from the cylinder head through the flange of the intake manifold to the intake pipe.

Preferably, the EGR system also includes a valve for controlling the flow of exhaust from the exhaust manifold into the intake manifold. This valve is mounted to the cylinder head.

Advantageously, the system of the present invention is arranged in a manner which is compact and which simplifies manufacture and assembly of the engine as including the EGR system.

Further objects, features, and advantages of the present invention over the prior art will become apparent from the detailed description of the drawings which follows, when considered with the attached figures.

DETAILED DESCRIPTION OF THE PREFERRED EMBODIMENTS

The present invention is an exhaust gas recirculation (EGR) system for an internal combustion engine. In general, the EGR system is arranged to route exhaust gases from an exhaust system of the engine into an intake system of the engine. In accordance with the present invention, the EGR system includes an exhaust gas recirculation passage through a cylinder head portion of the engine.

Figure 1:
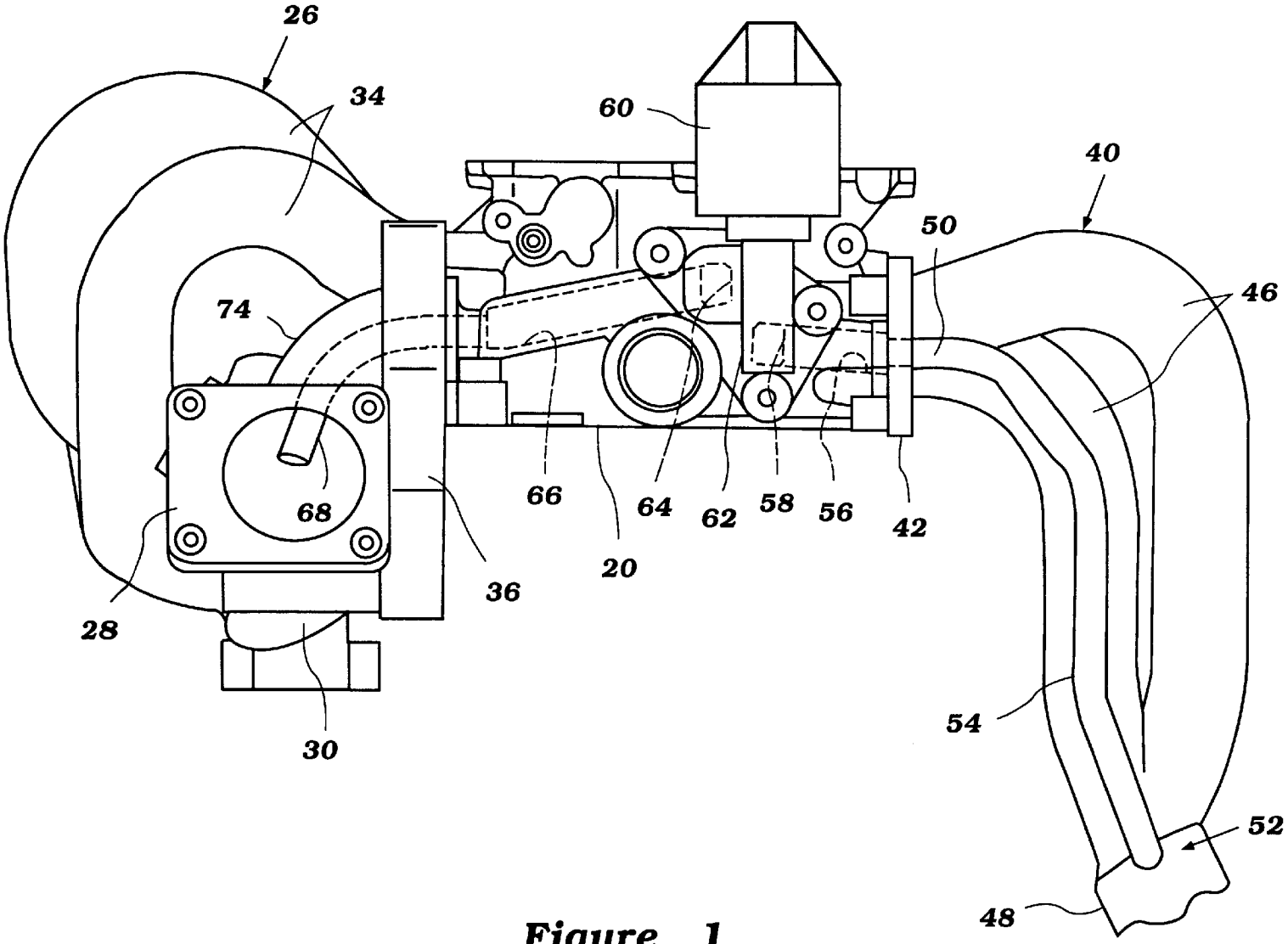
FIG. 1 is an end view of a cylinder head having an intake and an exhaust manifold connected thereto and illustrating an exhaust gas recirculation system in accordance with the present invention associated therewith.

The EGR system in accordance with the present invention is illustrated in FIG. 1. As illustrated, the system has particular utility when used in conjunction with a multi-cylinder internal combustion engine having a cylinder head 20 connected to a cylinder block (not shown). The cylinder head 20 cooperates with the cylinder block to define multiple cylinders or combustion chambers in which combustion of a fuel and air mixture occurs.

A piston (not shown) may be movably mounted in each cylinder and connected to a crankshaft arranged to drive a propulsion apparatus. For example, the engine may be used to propel an automobile or outboard motor of a watercraft. One skilled in the art will appreciate the variety of engine layouts with which the cylinder head and associated EGR system have utility and the particular uses of the engine.

Figure 3:
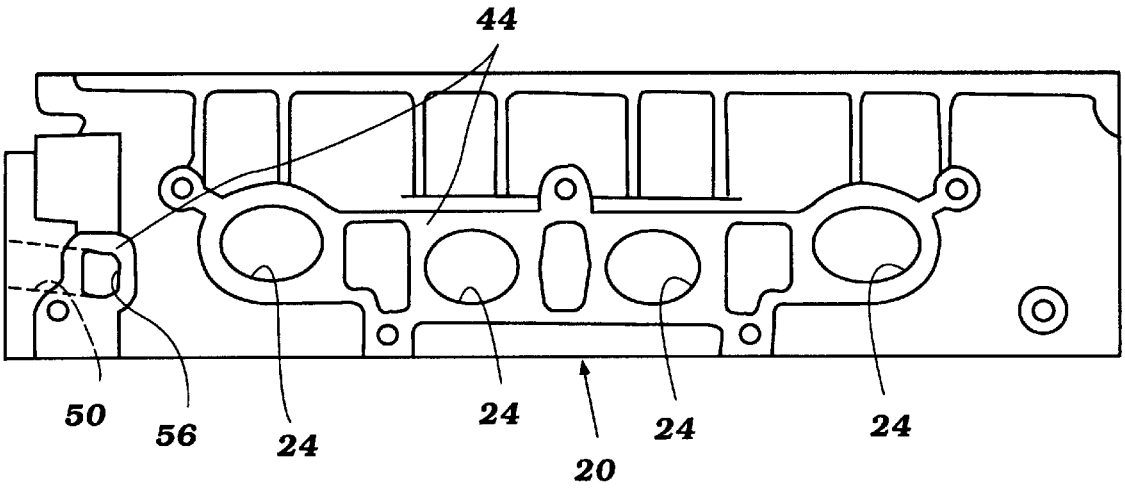
FIG. 3 is a first side view of the cylinder head illustrated in FIG. 1 with the exhaust manifold removed.
Figure 4:
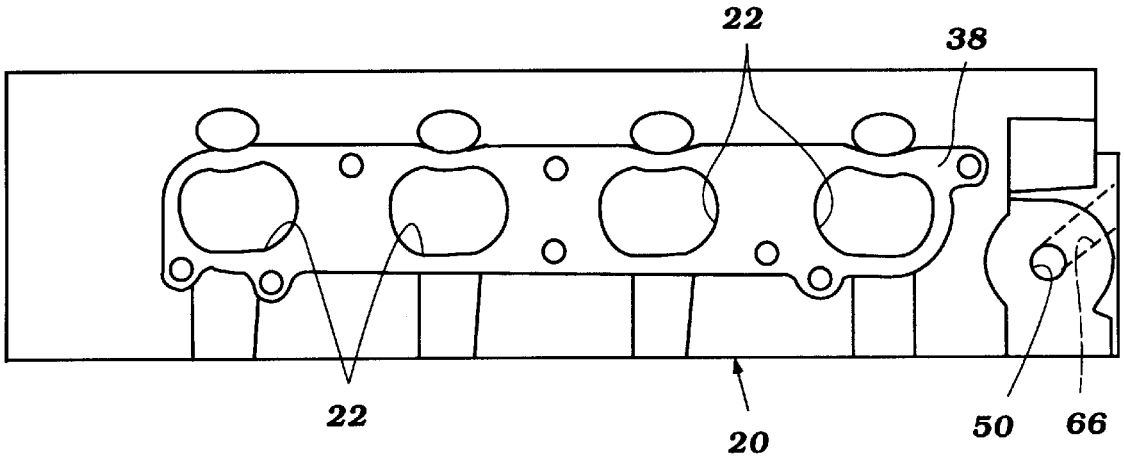
FIG. 4 is an opposite side view of the cylinder head from that illustrated in FIG. 3, with the intake manifold removed.

The engine includes an intake system for routing an air and fuel charge to each combustion chamber, and an exhaust system for routing exhaust generated by combustion from the combustion chambers. The intake system includes an intake manifold 26 connected to the cylinder head 20 and having at least one passage therethrough and at least one intake passage 22 leading through the cylinder head to each combustion chamber. The exhaust system includes an exhaust manifold 40 connected to the cylinder head 20 and having at least one passage therethrough and at least one exhaust passage 24 leading from each combustion chamber through the cylinder head. FIG. 4 illustrates the intake passages 22 leading through the cylinder head 20 to each cylinder or combustion chamber. Likewise, FIG. 3 illustrates the exhaust passage 24 leading through the cylinder head 20 from each cylinder.

In the present invention, the engine is of the four-cylinder variety, and as such, there are four intake passages 22 and exhaust passages 24. It will be understood to those skilled in the art that the engine may contain a greater or lesser number of cylinders and associated intake pipes.

Figure 2:
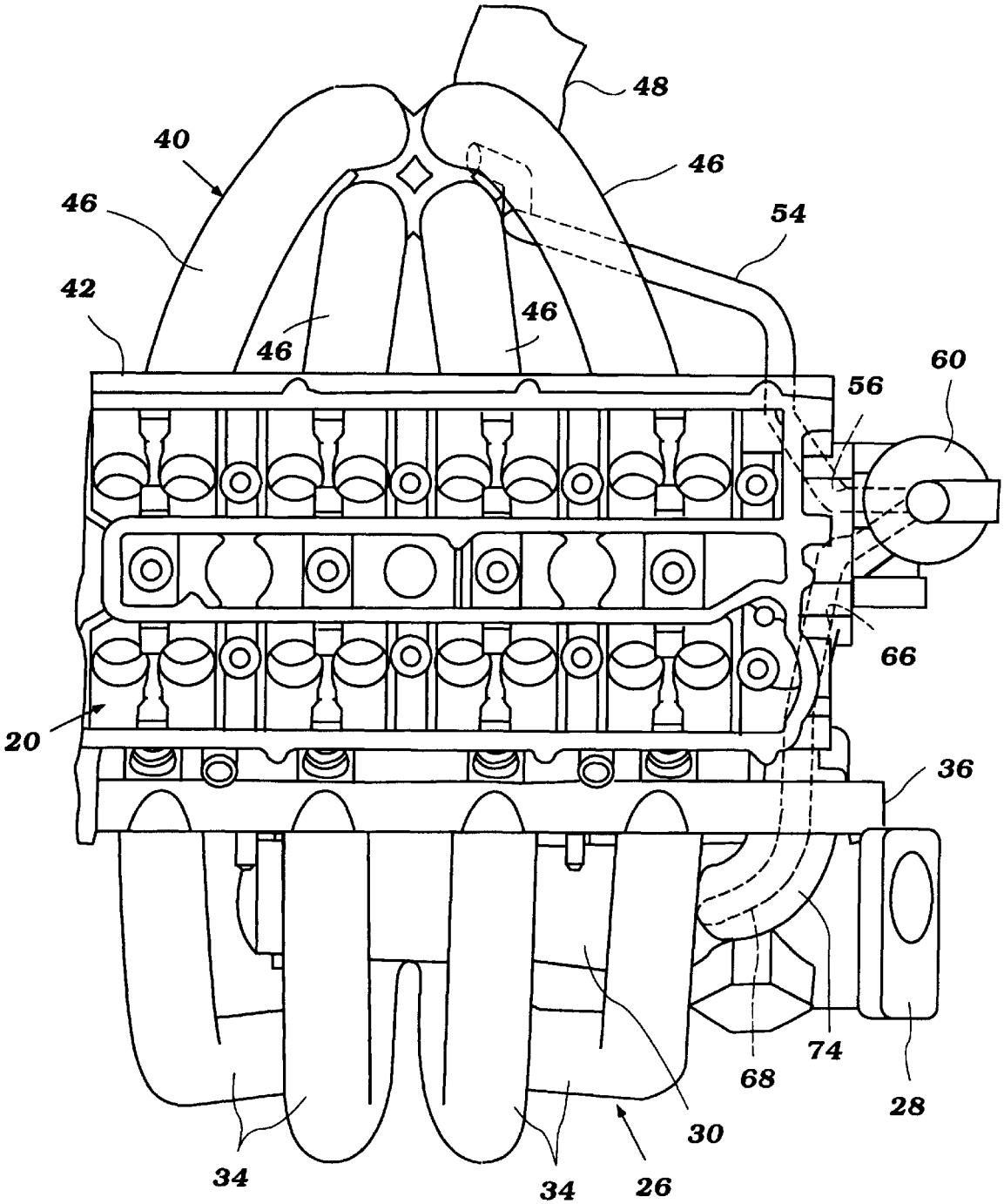
FIG. 2 is a top view of the cylinder head and exhaust gas recirculation system.
Figure 5:
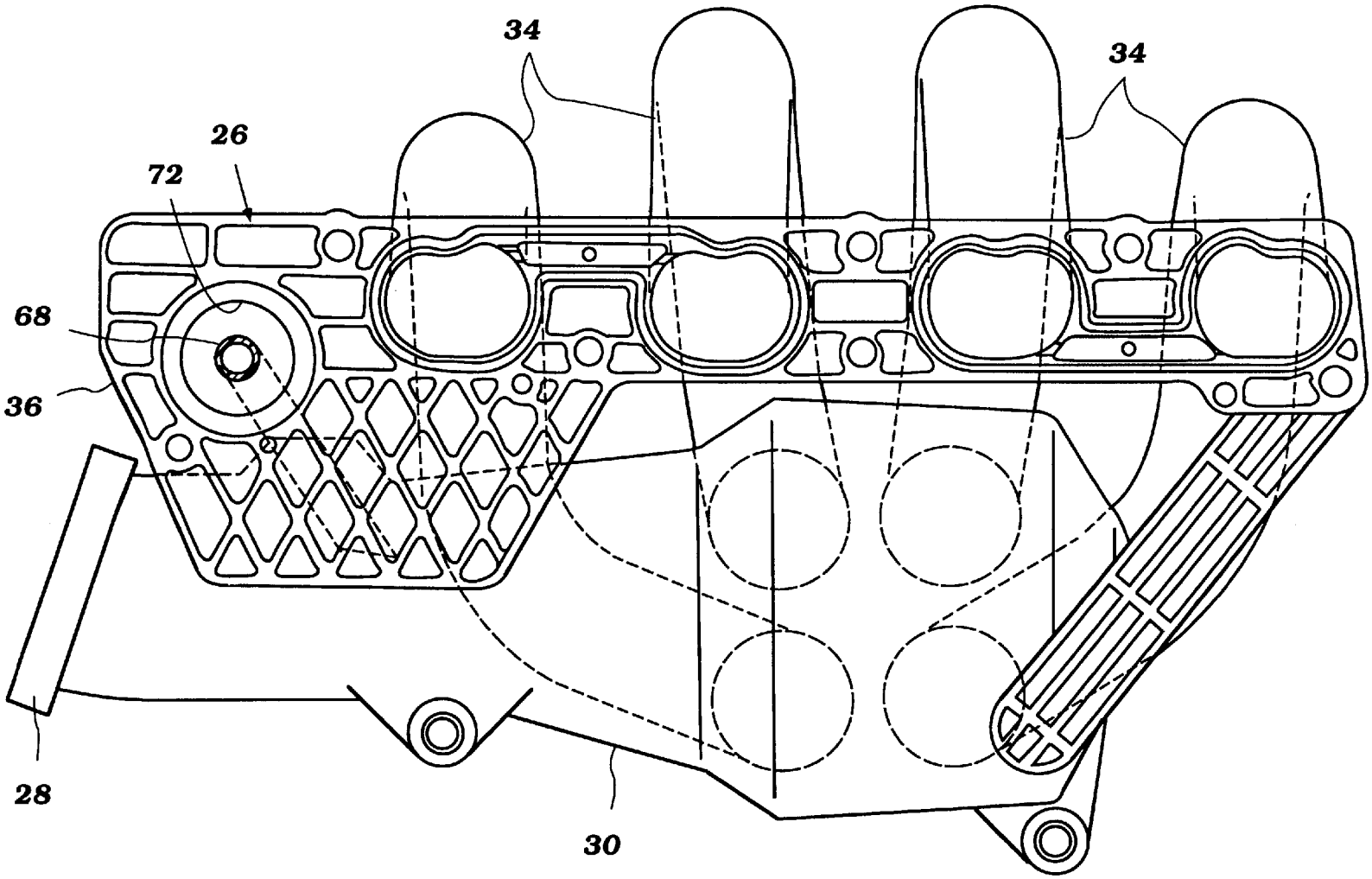
FIG. 5 is a plan view of the intake manifold associated with the cylinder head as illustrated in FIG. 1.

Referring again to FIG. 1, a charge of air and fuel is supplied to each intake passage 22, and thereon to its associated cylinder, through the intake manifold 26. The intake manifold 26 preferably has a first end with a mounting flange 28 adapted to mount an intake air source, such as an air cleaner. As best illustrated in FIGS. 2 and 5, an expanded pipe or plenum portion 30 of the intake manifold 26 extends from the flange 28. Branch or individual intake pipes 34 extend from the plenum portion 30 generally opposite the flange 28. An intake passage leads through the flange 28, plenum portion 30 and each branch pipe 34.

Each branch pipe 34 terminates opposite the plenum portion 30 at a cylinder head mounting flange portion 36 of the intake manifold 26. The mounting flange 36 has a passage therethrough corresponding to the passage through each branch pipe 34. This mounting flange 36 is adapted to abut a mounting surface 38 of the cylinder head 20 adjacent the entrances of the intake passages 22. The intake manifold 26 may be connected to the cylinder head 20 in a variety of manners known to those skilled in the art, such as by a number of threaded fasteners.

When connected, the mounting flange 36 of the manifold 26 abuts the mounting surface 38 of the cylinder head 20. The passage through each branch pipe 34 is aligned with a corresponding intake passage 22 leading through the cylinder head 20 to a cylinder. In this manner air and fuel are supplied to each cylinder for combustion therein.

Exhaust is routed from each cylinder through one of the exhaust passages 24 in the cylinder head 20, and thereon to a point external to the head by the exhaust manifold 40. The exhaust manifold 40 has a mounting flange 42 for abutment against a mounting surface 44 of the cylinder head 20 surrounding the exit of each exhaust passage 24. As illustrated, the cylinder head 20 is arranged so that the mounting surfaces 38, 44 for the intake and exhaust manifolds 26, 40 are generally positioned on opposite sides of the cylinder head 20. As will be appreciated by those of skill in the art, the cylinder head 20 may be arranged in other fashions.

The exhaust manifold 40 includes a branch exhaust pipe 46 corresponding to each exhaust passage 24. These branch exhaust pipes 46 extend from the flange 42 to a merge pipe portion 48 of the manifold some distance from the flange 42. The merge pipe portion 48 of the manifold 40 may be connected to a muffler or other exhaust system feature leading to an exhaust discharge.

The flange 42 has a passage therethrough corresponding to each exhaust passage 24. The passages through the flange 42 are aligned with those through the individual branch exhaust pipes 46 leading to an enlarged passage defined by the merge pipe portion 48.

The exhaust manifold 40 may be connected to the cylinder head 20 in a similar fashion to the intake manifold 26, such as with threaded fasteners.

The EGR system of the present invention includes a recirculation passage 50 extending between the exhaust manifold 40 and intake manifold 26 and through the cylinder head 20. As best illustrated in FIG. 1, an inlet end 52 of the passage 50 is in communication with exhaust flowing through the exhaust manifold 40. Preferably, the inlet end 52 is in communication with the passage through the merge pipe portion 48 of the manifold 40.

A recirculation pipe 54 defines that portion of the passage 50 between the merge pipe portion 48 and the flange 42 of the exhaust manifold 40. This pipe 54 preferably extends along one of the branch pipes 46 to minimize the space occupied by the exhaust manifold 40 and associated EGR system.

The pipe 54 extends to the flange 42 through which is provided an aligned bore or passage forming a portion of the recirculation passage 50. This passage through the flange 42 is aligned with a portion of the passage extending through the cylinder head 20 from the exhaust manifold mounting surface 44 to the intake manifold mounting surface 38. Preferably, means are provided along this portion of the passage 50 through the cylinder head 20 for regulating the flow of exhaust gas from the exhaust system to the intake system.

Preferably, an inlet portion 56 of the recirculation passage 50 extends from the mounting surface 44 into the cylinder head 20 to an EGR control valve 60. The valve 60 is connected to the cylinder head 20 and has a body portion 62 extending into a mounting area defined in the cylinder head 20. The inlet 58 is formed in the body portion 62. An internal passage is defined from the inlet 58 through the body 62 to an outlet 64.

This valve 60, which comprises the preferred means for regulation the exhaust flow, and as is well known in the art, is arranged to only selectively permit the flow of exhaust gas therethrough from the inlet 58 to the outlet 64. This valve 60 may be electronically controlled, be diaphragm operated by engine air pressure or other means known in the art so as to control the flow of exhaust in a timed manner. This particular control strategy forms no part of the present invention and is thus not described in detail here.

An outlet portion 66 of the recirculation passage 50 extends from the outlet 64 of the valve 60 through the cylinder head 20 to the mounting surface 38 for the intake manifold mounting. Means are provided for routing exhaust gas from this portion 66 of the passage 50 into a passage through the intake manifold 26.

Preferably, a discharge pipe 68 extends from the outlet portion 66 into the plenum portion 30 of the intake manifold 26. A flexible coupling is provided for the pipe 68 such that the pipe 68 remains connected to the head 20 and extends into the manifold 26 while still permitting some relative movement (for purposes of alignment in mounting, thermal expansion and the like) between with the manifold and head without disrupting the flow of exhaust gas to the intake manifold.

Figure 6:
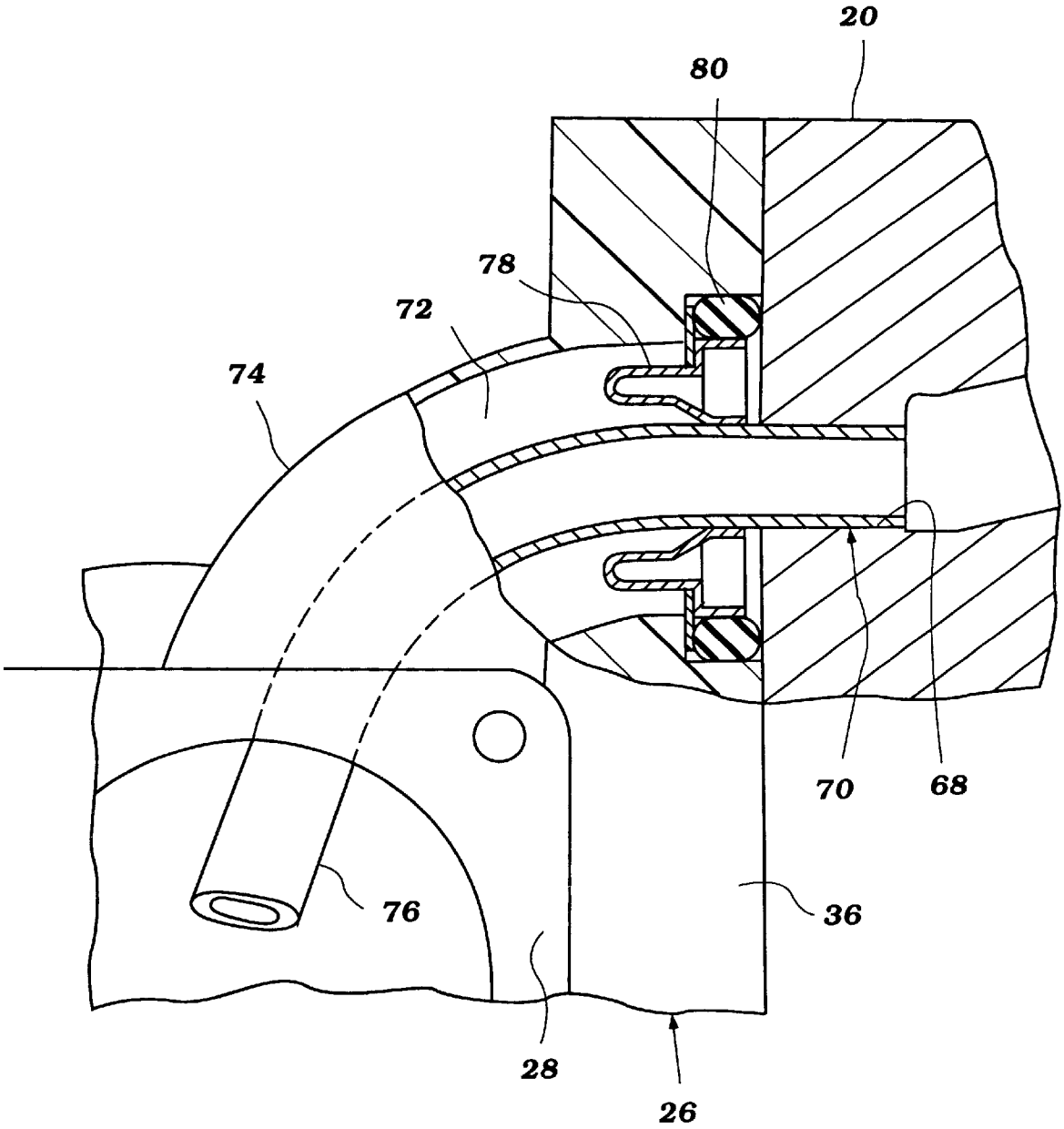
FIG. 6 is a partial cross-sectional view illustrating the connection of the intake manifold and cylinder head.

Referring to FIG. 6, the pipe 68 preferably defines a passage therethrough serving as a portion of the recirculation passage 50. The pipe 68 has its first end 70 positioned within the cylinder head 20. The pipe 68 preferably extends through a passage 72 defined through the flange 36 of the manifold and a pipe portion 74 thereof extending from the flange to the expanded portion 30. A second end 76 of the pipe 68 is positioned within the plenum portion 30 of the manifold 26.

Preferably, the pipe 68 flexibly supported by mounting. As illustrated, the mounting includes a pipe holder or guide 78 connected to the flange 36 within the passage defined therethrough. This pipe holder 78 has a passage through which the pipe 68 extends, and holds the pipe 68 in place generally centered in the passage 72. A seal 80 is preferably provided at the interface of the flange 36 on the manifold and the mounting surface 38 on the cylinder head 20 at the location of the passage 70 for preventing intake air leakage.

The flow of exhaust through the EGR system of the present invention will now be described with reference to the Figures. Exhaust gas generated during combustion is expelled from the cylinders through the exhaust passages 24 through the cylinder head 20 into the branch exhaust pipes 46 and thereon through the merge pipe portion 48 of the exhaust manifold 40. Some of this exhaust gas flows into the intake end 52 of the recirculation passage 50. This exhaust gas flows through the pipe 54 and the passage through the flange 42 of the exhaust manifold 40 into the intake portion 56 of the passage 50 in the cylinder head 20.

The exhaust gas flows through the intake portion 56 to the valve inlet 58. If the valve 60 is in an open position, the exhaust gas flows through the valve 60 to the outlet 64 and along the outlet portion 66 of the passage 50 defined through the cylinder head 20.

The exhaust gas then flows into the discharge pipe 68 and therethrough to its discharge within the expanded pipe portion 30 of the intake manifold 26. There, the exhaust gas mixes with the intake air for delivery to the cylinders for combustion.

In accordance with the present invention, the EGR system is arranged in a manner which is compact and which is easy to manufacture and assemble. In particular, the incorporation of the exhaust gas recirculation passage into the manifolds in a manner such that the recalculation passage is completed by the connection of the manifolds to the cylinder head simplifies the construction of the system and of an engine including an EGR system. This arrangement eliminates the need for couplings for both exhaust gas passages and for the intake and exhaust manifold to cylinder head connections.

Also, the mounting of the valve 60 to the cylinder head 20 is in such a manner that a coupling between the valve 60 and exhaust recirculation pipe parts is eliminated. In the present arrangement, since the passage 50 extends through the cylinder head 20, the connection of the passage 50 to the valve 60 is provided by simply installing the valve 60 into the cylinder head.

Because the passage 50 extends through the cylinder head 20, external lines or pipes are avoided, simplifying the system, making it more reliable, and minimizing the space occupied thereby.

Further, the use of the delivery pipe 76 mounted within the larger passage 72 defined by the pipe 74 of the intake manifold 26 provides a flexible mounting arrangement which eliminates the need for exacting tolerances in the manufacture and assembly of the head and intake manifold. As may be appreciated, a small variance in the size or shape of either the head 20 or the flange 36 of the intake manifold might lead to a misalignment between the passage 66 and a corresponding passage through the manifold flange, permitting exhaust gas leakage.

In order to complete the portion of the exhaust gas recirculation passage 50 from the cylinder head 20 to the intake passage, the flexible pipe 76 is used. This pipe 76 has its first end 72 securely positioned in the passage a66, and may bend to accommodate adjustments in the relative position of the intake manifold 36 and the cylinder head 20 for purposes of aligning the cylinder head and manifold. At the same time, the seal 80 further serves to prevent leakage at the cylinder head 20/manifold 26 interface.

Another advantage of the preferred embodiment of the invention is that the exhaust gas is routed from the merge pipe portion 48 of the exhaust manifold 50, as opposed to from just a passage corresponding to a single one of the cylinders. In this manner, a mixture of well-burned exhaust at high pressure is provided through the system instead of a pulsating supply which may at times be rather rich in unburned fuel. Likewise, the exhaust is delivered to the plenum portion 30 of the intake manifold 26 for delivery to all of the combustion chambers or cylinders and not just a single cylinder.

Of course, the foregoing description is that of preferred embodiments of the invention, and various changes and modifications may be made without departing from the spirit and scope of the invention, as defined by the appended claims.

What is claimed is:

1. An exhaust gas recirculation system for an internal combustion engine having a cylinder head and an intake system and an exhaust system, said intake system including an intake manifold having at least one intake pipe connecting to a mounting flange, said flange connected to said cylinder head such that a passage leading through said intake pipe is aligned with an intake passage through said cylinder head leading to a combustion chamber, said exhaust system including an exhaust manifold with a mounting flange and at least one exhaust pipe leading therefrom, said flange of said exhaust pipe connected to said cylinder head such that an exhaust passage leading through said cylinder head from a combustion chamber is aligned with a passage through said exhaust pipe, an exhaust gas recirculation passage extending from said exhaust pipe through said flange of said exhaust manifold, through a portion of said cylinder head, and through said flange of said intake manifold to said intake pipe for routing exhaust gas flowing through said exhaust pipe into said intake pipe, and an exhaust gas recirculation valve mounted directly on said cylinder head for controlling the flow through the portion of said exhaust gas recirculation passage passing through said cylinder head.

2. The exhaust gas recirculation system in accordance with claim 1, wherein said exhaust manifold has multiple branch pipes leading from said flange to a merge pipe, and wherein said exhaust gas passage extends from said merge pipe.

3. The exhaust gas recirculation system in accordance with claim 1, wherein a pipe separate from said exhaust pipe defines the exhaust manifold portion of said recirculation passage that extends between said exhaust pipe and said flange of said exhaust manifold.

4. The exhaust gas recirculation system in accordance with claim 1, wherein a pipe separate from said intake pipe defines the portion of said recirculation passage that extends between said cylinder head and said intake pipe.

5. The exhaust gas recirculation system in accordance with claim 1, wherein said cylinder head has at least two intake passages and said intake manifold comprises a plenum part leading to a respective intake pipe corresponding to each intake passage and wherein said exhaust recirculation passage communicates directly with said plenum part of said intake manifold.

6. The exhaust gas recirculation system in accordance with claim 5, wherein a further pipe portion of said intake manifold extends from said flange to said plenum part and defines a guide passage that surrounds a portion of said recirculation passage that extends from said cylinder head to said plenum part.

7. The exhaust gas recirculation system in accordance with claim 6, wherein the surrounded portion of said recirculation passage that extends from said cylinder head to said plenum portion is formed by a separate tube.

* * * * *